United States Patent [19]

Bowman et al.

[11] 4,350,097

[45] Sep. 21, 1982

[54] NONELECTRIC DELAY DETONATOR WITH TUBULAR CONNECTING ARRANGEMENT

[75] Inventors: Arthur F. Bowman, Tamaqua; David G. Borg, Allentown, both of Pa.

[73] Assignee: Atlas Powder Company, Dallas, Tex.

[21] Appl. No.: 150,817

[22] Filed: May 19, 1980

[51] Int. Cl.[3] ..... C06C 5/04

[52] U.S. Cl. ..... 102/275.2; 102/275.3; 102/275.6; 102/275.7; 102/322; 102/331

[58] Field of Search ..... 102/275.2, 275.3, 275.4, 102/275.5, 275.6, 275.7, 322, 331

[56] References Cited

U.S. PATENT DOCUMENTS

| | | | |
|---|---|---|---|
| Re. 20,190 | 12/1936 | Lewis | 102/8 |
| Re. 30,621 | 5/1981 | Calder, Jr. et al. . | |
| 2,475,875 | 7/1949 | Burrows et al. | 102/22 |
| 2,587,694 | 3/1952 | Chalmers et al. | 102/275.4 |
| 2,618,221 | 11/1952 | Lowe | 102/29 |
| 2,707,438 | 5/1955 | Mann et al. | 102/27 |
| 2,707,439 | 5/1955 | Hamilton | 102/27 |
| 2,736,263 | 2/1956 | Lewis et al. | 102/275.3 |
| 2,796,834 | 6/1957 | McCaffrey et al. | 102/27 |
| 2,891,476 | 6/1959 | Forsyth | 102/27 |
| 2,944,485 | 7/1960 | Ely et al. | 102/24 |
| 3,020,844 | 2/1962 | Miller | 102/27 |
| 3,021,786 | 2/1962 | Miller et al. | 102/27 |
| 3,106,892 | 10/1963 | Miller | 102/27 |
| 3,122,097 | 2/1964 | Miller | 102/27 |
| 3,306,201 | 2/1967 | Noddin | 102/27 |
| 3,342,133 | 9/1967 | Strom et al. | 102/27 |
| 3,343,487 | 9/1967 | Hare et al. | 102/27 |
| 3,353,485 | 11/1967 | Miller et al. | 102/27 |
| 3,371,607 | 3/1968 | Olsson | 102/27 |
| 3,431,849 | 3/1969 | Kern et al. | 102/24 |
| 3,590,739 | 7/1971 | Persson | 102/27 |
| 3,709,149 | 1/1973 | Driscoll | 102/22 |
| 3,776,135 | 12/1973 | Zebree | 102/29 |
| 3,981,240 | 9/1976 | Gladden | 102/29 |
| 3,987,732 | 10/1976 | Spraggs et al. | 102/27 R |
| 4,060,033 | 11/1977 | Postupack et al. | 102/24 R |
| 4,060,034 | 11/1977 | Bowman et al. | 102/24 R |
| 4,073,235 | 2/1978 | Hopler | 102/22 |
| 4,133,247 | 1/1979 | Calder, Jr. et al. . | |
| 4,141,296 | 2/1979 | Calder, Jr. et al. . | |
| 4,165,691 | 8/1979 | Bowman et al. | 102/275.7 |
| 4,178,852 | 12/1979 | Smith et al. | 102/275.4 |
| 4,215,631 | 8/1980 | Rucker | 102/275.5 |
| 4,239,003 | 12/1980 | Savitt | 102/275.5 |
| 4,265,177 | 5/1981 | Lundborg et al. | 102/275.5 X |
| 4,295,424 | 10/1981 | Smith et al. . | |

FOREIGN PATENT DOCUMENTS

| | | | |
|---|---|---|---|
| 705161 | 3/1965 | Canada | 102/30 |
| 748820 | 5/1956 | United Kingdom . | |
| 855749 | 12/1960 | United Kingdom . | |
| 982364 | 2/1965 | United Kingdom . | |

*Primary Examiner*—Peter A. Nelson

*Attorney, Agent, or Firm*—Richards, Harris & Medlock

[57] ABSTRACT

A nonelectric detonator device is provided for initiation by a detonator cord, the nonelectric detonator device being securable to a cartridge explosive, an explosive primer charge or one or more outgoing detonator cords, for example, for initiation thereof by the nonelectric detonator device. The detonator device includes an alignment member for securing a detonator cord in initiating relationship thereto. A second alignment member is provided for aligning outgoing detonating cords for initiation by the nonelectric detonator device.

24 Claims, 8 Drawing Figures

NONELECTRIC DELAY DETONATOR WITH TUBULAR CONNECTING ARRANGEMENT

BACKGROUND OF THE INVENTION

In open pit mines, open pit quarries, and other types of open pit mining operations, blasting is carried out using vertical boreholes ranging in diameter from about 2 inches to about 17 inches. Blasting is carried out to remove overburden covering an ore body, and to break ore to allow it to be loaded and hauled away. Economic considerations require that blasting operations make optimum use of available explosive energy. This includes obtaining the desired breakage and throw of the ore. While accomplishing the above, it is becoming increasingly important to minimize the effects of blasting on nearby structures such as homes, schools and offices. To control rock fragmentation, rock throw and vibrations, it is often desirable to initiate a column of explosives at the bottom of a borehole. Such bottom hole initiation requires that the signal carrier, such as a detonator cord, which transmits the firing signal to the detonator in the bottom of the borehole not interact or react with the explosive column. This can be accomplished by either using a signal carrier which exerts no external force when it functions or by using an explosive column which is not effected by any action of the signal carrier when it functions.

When delay detonators are used in a blast to achieve bottom hole initiation, the number of boreholes which can be individually delayed to initiate at different times is limited by the available number of detonator delay periods or delay times. The use of a surface delay system in combination with an in-hole delay system could extend this number of individually delayed boreholes indefinitely.

In blasting, insensitive explosives or blasting agents such as ammonium nitrate-fuel oil compositions, for example, are detonated by booster or primer charges containing high explosives sensitive enough to be detonated by ordinary blasting caps. For safe and efficient use, the detonation of the primer charge that is used to initiate such blasting agents must be capable of being precisely timed and and must be highly reliable. While electric blasting caps have the advantage of precise timing, there are those who feel that the advantages of electrical ignition are outweighed by the potential for inadvertent energizing of all or part of the electric blasting circuit by extraneous electricity.

In using nonelectric detonators initiated by detonator cords, it is essential for reliable initiation that the detonator cord be adjacent that portion of the detonator that receives the explosive signal from the detonator cord. In addition, it is important that the detonator cord signal not directly interact with or initiate the primer explosive.

Therefore, a need exists for a nonelectric detonator for use in open pit mines and quarries where it is desired to achieve bottom hole initiation when used in conjunction with detonating cord. A need also exists for a simple, reliable, inexpensive and efficient device and method for securing a detonator cord in initiating relationship to a nonelectric detonator and for securing the nonelectric detonator to an explosive primer charge for initiation by the nonelectric detonator while protecting the primer charge from interaction or initiation by the detonator cord. In addition, a need exists for a device and method for a surface delay system that can be used in combination with an in-hole delay system for extending indefinitely the number of individually delayed boreholes.

SUMMARY OF THE INVENTION

According to the invention, a device is provided for aligning a detonator cord to a nonelectric detonator for an explosive charge which comprises a tubular member for receiving a segment of a continuous length of detonator cord passing therethrough, the tubular member retaining a sensor means therewithin which communicates with a nonelectric detonator, such that said sensor means will become initiated by explosion of the segment of detonator cord passing through the tubular member and transmit an initiating explosive signal to the detonator.

In one embodiment, the device of the subject invention comprises a detonator cord receiving tube open at both ends for receiving the segment of detonator cord therein and having a detonator receiving tube operatively connected thereto adjacent its midportion and communicating with the interior of the detonator cord receiving tube, the detonator receiving tube being dimensioned to receive a nonelectric detonator therein which comprises a sensor which is positioned adjacent the intersection between the detonator cord receiving tube and the detonator receiving tube in explosive alignment with a nonelectric detonator charge. In one embodiment, the nonelectric detonator comprises a tubular member having a sensor operatively positioned at one end thereof, a signal tube for receiving the output of said sensor positioned in the midportion thereof, and an explosive charge positioned at the opposite end of the tube from said initiator. Optionally, a delay element can be positioned between the signal tube and the priming charge.

In another embodiment of the present invention, the alignment device includes a slot located in the detonator cord receiving tube for inserting and locking a detonator cord therein for preventing movement of the detonator cord within and longitudinally of the detonator cord tube. The device may also include a projecting member for securing the alignment device to an explosive primer charge.

According to another embodiment of the present invention, a device is provided for aligning an incoming detonator cord to a nonelectric detonator for initiating one or more outgoing detonator cords, which device comprises a tubular member for receiving a segment of a continuous length of the incoming detonator cord passing therethrough, the tubular member retaining a sensor means therewithin which communicates with an nonelectric detonator, such that the sensor means will become initiated by explosion of the segment of incoming detonator cord passing through the tubular member and transmit an initiating explosive signal to the detonator. An incoming detonator cord alignment device is provided that is securable to the end of the nonelectric delay detonator and allows one or more outgoing detonator cords to be secured in initiating relationship to the explosive charge of a detonator thereby allowing initiation of the outgoing detonator cords. Thus, the time delay of the nonelectric delay detonator can be utilized to provide a surface delay and the outgoing detonator cords that have been initiated by the nonelectric detonator can initiate other sensor means as previously described.

BRIEF DESCRIPTION OF THE DRAWINGS

A more complete understanding of the invention may be had by reference to the following Detailed Description when taken in conjunction with the accompanying Drawings wherein.

DETAILED DESCRIPTION OF THE INVENTION

According to the present invention, an alignment member and a nonelectric detonator device that includes the alignment device in combination with a nonelectric detonator is provided which is simple, easy to use, reliable and economical.

Figure 1:
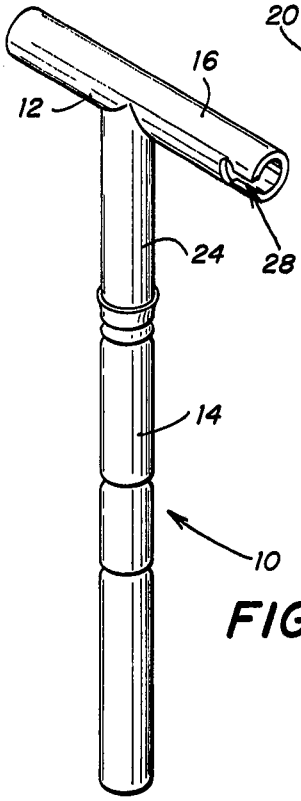
FIG. 1 is a perspective view of the alignment device of the present invention for securing the detonator cord and nonelectric detonator in initiating relationship relative to each other.

A nonelectric detonator device according to the invention is illustrated in FIG. 1 and is generally indicated by reference numeral 10. Nonelectric detonator device 10 includes alignment member 12 and nonelectric detonator 14. Preferably, nonelectric detonator 14 is a delay detonator.

Figure 2:
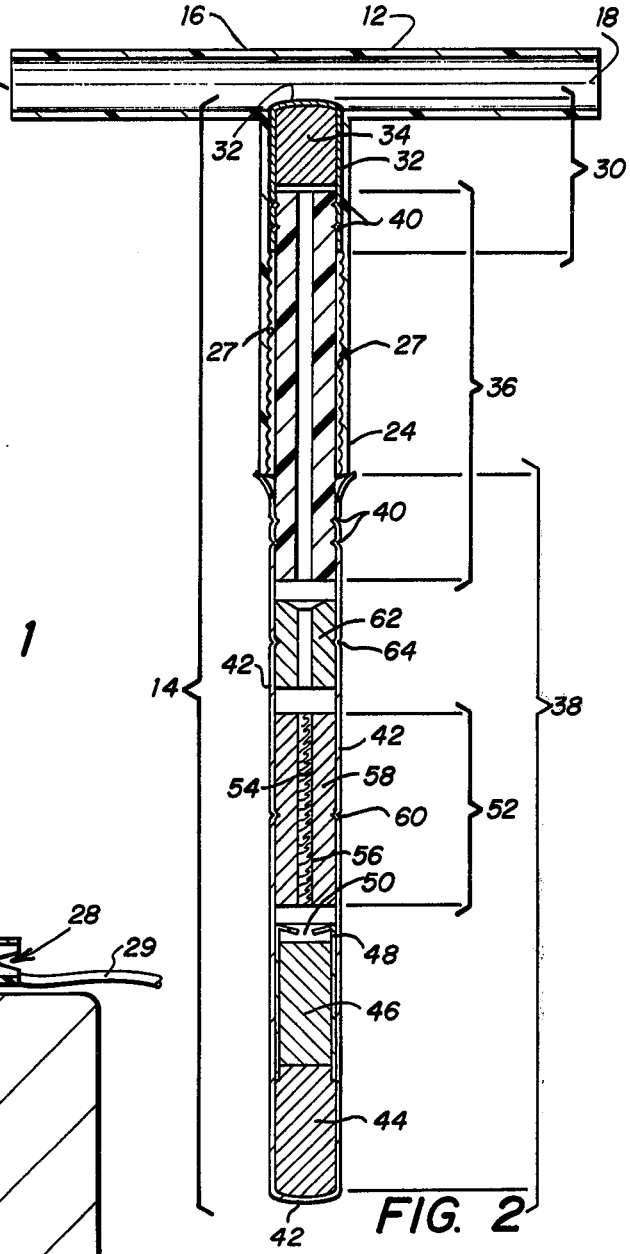
FIG. 2 is a sectional view of the alignment device and nonelectric detonator shown in FIG. 1.

Referring to the drawings generally and particularly to FIG. 2, a cross-sectional view of nonelectric detonator 10 is shown. Alignment member 12 includes a detonator cord receiving tube 16 that may be of any desired cross-sectional shape but preferably has a generally cylindrical cross-section with a first open end 18 and a second open end 20. Detonator cord receiving tube 16 is dimensioned to accommodate therein a detonator cord. Alignment member 12 also includes a detonator tube 24, detonator tube 24 having two open ends, one end being joined to and communicating with the interior of detonator cord receiving tube 16. Preferably, the junction of detonator cord receiving tube 16 with detonator tube 24 forms an angle of about 90° measured along the longitudinal axes of tubes 16 and 24. Detonator tube 24 is dimensioned to allow insertion of nonelectric detonator 14 in frictional engagement with detonator tube 24 when nonelectric detonator 14 is aligned in initiating position relative to detonator tube 24, allowing nonelectric detonator 14 to be secured within detonator tube 24 and to receive an explosive signal from the detonator cord located within detonator cord receiving tube 16. Preferably, detonator tube 24 has a plurality of circumferential serrations 27 to facilitate frictional engagement with nonelectric detonator 14. The diameter of circumferential serrations 27 is slightly less than the exterior dimensions of that portion of nonelectric detonator 14 that is inserted into detonator tube 24 so that when nonelectric detonator 14 is inserted therein, serrations 27 are deformed slightly and a tight, frictional fit results.

Alignment member 12 is preferably constructed of a substantially rigid plastic. Alignment member 12 can be fabricated, for example, by injection molding of high density polyethylene.

Figure 3:
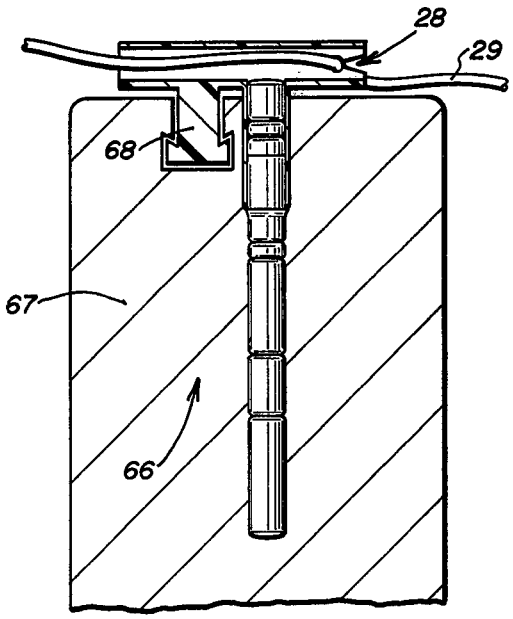
FIG. 3 illustrates an alternate embodiment of the alignment device shown with a detonator cord and nonelectric detonator in initiating position with an explosive primer charge.

Alignment member 12 preferably incorporates therein a slot 28, located at one end of detonator cord tube 16 as shown in FIG. 1. Slot 28 permits the detonator cord to be inserted therein for securing the detonator cord to alignment member 12, thereby eliminating the need for the detonator cord to be knotted adjacent either open end 18 or open end 20. Preferably, slot 28 has a configuration and dimensions, relative to the size of the detonator cord to be used in conjunction with nonelectric detonator device 10, so that the detonator cord can be snap-locked into slot 28. One suitable shape for slot 28 is depicted in FIGS. 1 and 3, in which slot 28 has a "keyhole" shape. Slot 28 may be of any desired shape as long as a detonator cord can be secured therein. FIG. 3, which will be hereinafter described in further detail, illustrates a detonator cord 29 snap-locked in place in alignment member 12. Thus, the alignment device and nonelectric detonator device of the present invention allow a detonator cord to be secured thereto without knotting and therefore, detonator cords of the type that are not suitable for knotting can be used.

Referring to FIG. 2, there is illustrated a sectional view of nonelectric detonator device 10 which includes alignment member 12 and nonelectric detonator 14. Nonelectric detonator 14 includes a detonation sensor 30 which senses the detonation of a detonating cord downline. Detonation sensor 30 is constructed of a metal shell 32, for example, copper, copper alloy, aluminum or aluminum alloy. Preferably, aluminum alloy is used to construct metal shell 32. The bottom thickness of metal shell 32 must be adjusted so as to allow the shock energy from the detonating cord downline to be transmitted through the bottom of metal shell 32 adjacent the detonating cord and initiate explosive charge 34 contained within metal shell 32. For example, the bottom thickness of an aluminum shell should be between about 0.005 inches and 0.025 inches. Explosive charge 34 must be sensitive to initiation by the shock energy from the detonating cord. Suitable explosives include, for example, diazo, HNM, lead azide, lead styphnate and mixtures thereof. Explosive charge 34 must have sufficient output to transmit a shock signal through passive signal carrier 36 to initiate a nonelectric blasting cap 38. Passive signal carrier 36 consists of an empty plastic or rubber tube, preferably plastic, which acts as a passive signal carrier and does not itself enter into any reaction. Passive signal carrier 36 preferably has an inside diameter of from about 1.0 to about 4.0 millimeters and has a length of from about 25 to about 2,000 millimeters, the outside diameter of passive signal carrier 36 substantially conforms to the inside diameters of detonation sensor 30 and nonelectric blasting cap 38.

Passive signal carrier 36 connects detonation sensor 30 with nonelectric blasting cap 38. Preferably, passive signal carrier 36 is secured to detonation sensor 30 and nonelectric blasting cap 38 by means of suitable crimps or indentations 40, located in detonation sensor 30 and nonelectric blasting cap 38 to secure passive signal carrier 36 to detontation sensor 30 and nonelectric blasting cap 38.

Nonelectric blasting cap 38 comprises a metal shell 42 made of copper, copper alloy, aluminum, aluminum alloy or steel, for example, that is closed at one end. Preferably, the open end of shell 42 is flared slightly so that the open end of metal shell 42 abuts the end of detonator tube 24, preventing further insertion of nonelectric detonator 14 into detonator tube 24. Thus, the length of nonelectric detonator 14 above the flared end of metal shell 42 should correspond substantially with the length of detonator tube 24, so that detonation sensor 30 can be in intimate contact with a detonator cord inserted through detonator cord receiving tube 16.

A base explosive charge 44 is located in the extreme bottom or closed end of blasting cap shell 42. Base explosive charge 44 is an explosive such as PETN, for example, and is preferably contained in an amount such that nonelectric blasting cap 38 is equivalent in explosive force to a number 8 blasting cap, for example. A primer explosive charge 46 is located adjacent and in contact with base explosive charge 44. Primer explosive charge 46 can be an explosive such as diazo, lead azide, HNM, diazo/HNM, or lead styphnate/lead azide, for example. A metal capsule 48, formed of copper, zinc, steel or aluminum, for example, may optionally be used above primer explosive charge 46 to hold both base explosive charge 44 and primer explosive charge 46 in place. Metal capsule 48 contains a small hole 50 to permit initiation of primer explosive charge 46.

A delay element 52 is located above metal capsule 48 or primer explosive charge 46 if metal capsule 48 is not used. Delay element 52 is designed to burn at a controlled rate thereby delaying initiation of primer explosive charge 46 and base explosive charge 44 after detonation sensor 30 receives an explosive signal from a detonator cord. Typical burning times for delay element 52 range from about 25 milliseconds up to several seconds by selection of the proper pyrotechnic powder 54. Delay element 52 consists of pyrotechnic powder 54 and metal tube 56. Metal tube 56 is open at both ends and contains pyrotechnic powder 54. Metal tube 56 is aligned such that one end is adjacent primer explosive charge 46 or metal capsule 48 and the other end of metal tube 56 is adjacent passive signal carrier 36. Preferably, metal tube 56 is contained within a plastic jacket 58, plastic jacket being held in place by a suitable crimp or indentation 60. As an alternative for delay element 52, a delay powder charge (not shown) can be located directly on primer explosive charge 46 or on metal capsule 48. The delay powder charge can be pressed into place.

Nonelectric blasting cap 38 preferably includes attenuator 62 which serves to focus and direct the shock signal from detonation sensor 30 onto pyrotechnic powder 54 of delay element 52. Attenuator 62 is made of an empty tube that contains a small hole, for example, about 0.040 inch, that is positioned directly above delay element 52. Attenuator 62 is held in place in metal shell 42 by a suitable crimp or indentation 64 in metal shell 42.

Referring to FIG. 3, there is illustrated a nonelectric detonator device 66 constructed in accordance with the present invention and shown with a primer charge 67. Detonator device 66 is similar to detonator device 10, and its component parts are referred to by like numerals, except that detonator device 66 includes a projection member 68 that forms a part of alignment member 12 and extends from detonator cord receiving tube 16. Primer charge 67 is shown sectionally in FIG. 3. Projection 68 preferably extends from detonator cord receiving tube 16 in the same general direction as detonator tube 24 and is of a configuration that provides a snap-locking effect when inserted into a complementary cavity located in primer charge 67. In another embodiment (not shown), detonator tube 24 may contain as an integral portion thereof the projection for securing the nonelectric detonator device of the invention to a primer charge.

Figure 4:
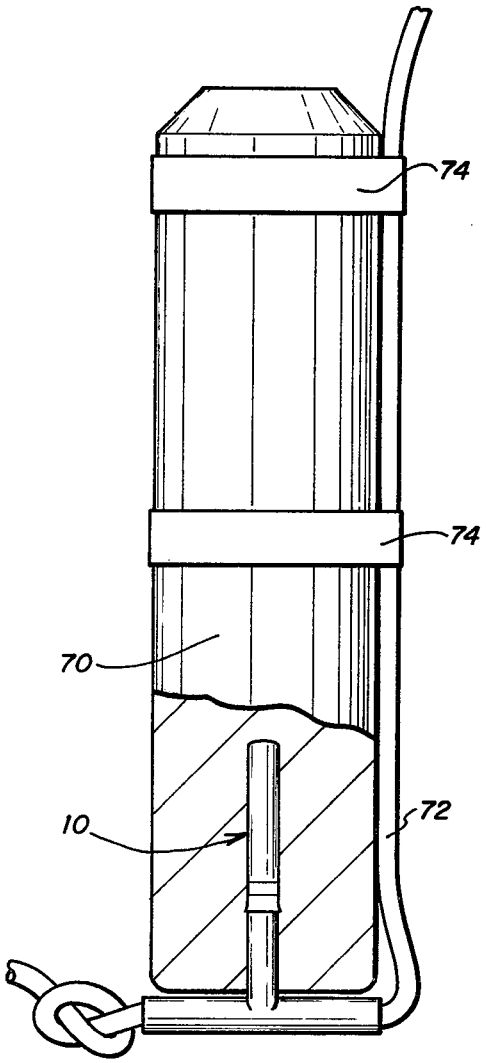
FIG. 4 illustrates an embodiment of the alignment device shown with a detonator cord and nonelectric detonator in initiating position with a cartridge type explosive.

As shown in FIG. 4, nonelectric detonator device 10 may also be used to initiate a cartridge type explosive 70. A detonator cord 72, similar to detonator cord 29, can be secured to cartridge type explosive 70 by any suitable means, such as by tape 74. Nonelectric detonator device 10 lies adjacent cartridge type explosive 70.

In accordance with another embodiment of the present invention, nonelectric detonator device 10 is utilized to effect the delay initiation of one or more outgoing detonator cords. Detonator device 10 includes alignment member 12 and nonelectric detonator 14, which, as previously described with reference to FIG. 2, is preferably a delay detonator. An incoming detonator cord 75 initiates detonator device 10.

Figure 6:
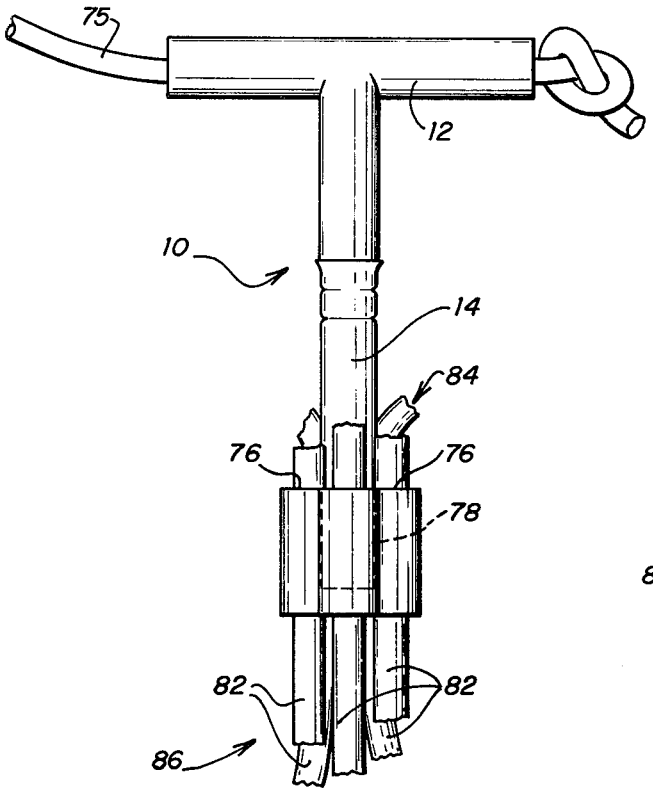
FIG. 6 is a side elevational view of the alignment device of the present invention in conjunction with a nonelectric detonator and detonator cord utilizing the outgoing detonator cord aligning device shown in FIG. 5.
Figure 5:
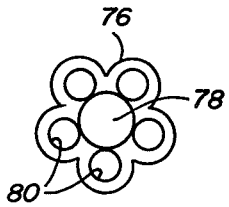
FIG. 5 is an end elevational view of an outgoing detonator cord aligning device in accordance with the present invention.

Referring to FIGS. 5 and 6, an outgoing detonator cord alignment cap 76 is provided for securing outgoing detonator cords for initiation by nonelectric detonator 14, and includes a well 78 and at least one outgoing detonator cord receiving passageway 80. Outgoing detonator cord alignment cap 76 is preferably utilized in conjunction with alignment member 12. Well 78 is dimensioned to secure in frictional engagement cap 76 on the bottom or closed end of blasting cap shell 42. Each passageway 80 is dimensioned to receive therein an outgoing detonator cord 82, as shown in FIG. 6. Each of the upper ends of outgoing detonator cords 82, referred to generally in FIG. 6 by reference numeral 84 may terminate in a knot (not shown) that is larger than passageway 80 so that each of outgoing detonator cords 82 is restrained from being pulled from passageway 80. As shown in FIG. 5, each passageway 80 is preferably adjacent well 78 of detonator cord alignment cap 76 for providing maximum reliability in initiating outgoing detonator cords 82 by detonation of nonelectric detonator 14.

Outgoing detonator cord alignment cap 76 can be manufactured, for example, from a block of a substantially rigid plastic or other suitable material and each passageway 80 and well 78 can be bored therein. Detonator cord alignment cap 76 could also, for example, be manufactured by injection molding. The shape of outgoing detonator cord alignment cap 76 is not critical as long as the outgoing detonator cord or cords are secured in initiating relationship with respect to nonelectric detonator 14.

Figure 7:
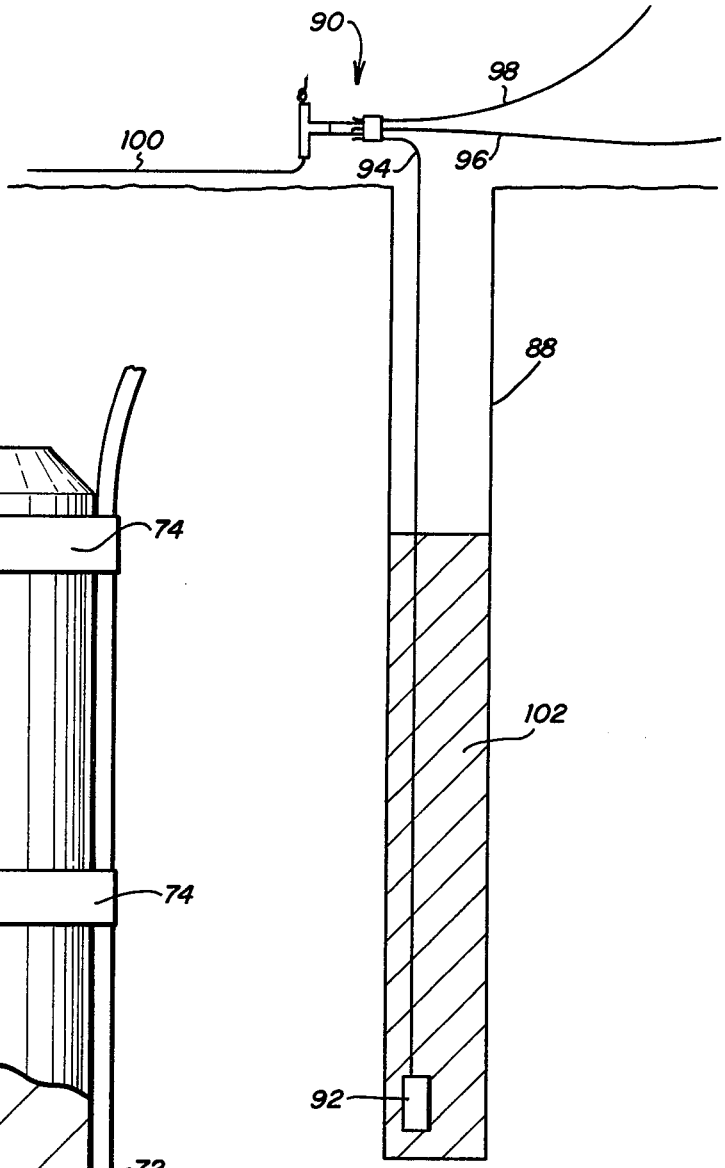
FIG. 7 is a schematic illustration of a detonator device similar to that shown in FIG. 6 utilized to provide a surface delay detonator system in conjunction with an in-hole delay in a typical borehole.

As illustrated in FIG. 6, a delay system 86 is provided that includes nonelectric detonator device 10 utilized in conjunction with outgoing detonator cord alignment cap 76 that retains outgoing detonator cords 82 in initiating relationship with nonelectric detonator 14. Detonator cords of various strengths or core loads can be utilized in such a system, even with core loads as low as 7.5 gr./ft. Thus, in accordance with the present invention, surface delays can be utilized with in-hole delays to achieve bottom hole initiation. As illustrated in FIG. 7, a typical borehole 88 is shown utilizing the surface delay system 90 together with an in-hole delay primer system 92. Surface delay system 90 is in accordance with the present invention and is similar to the delay system 86 illustrated in FIG. 6, except that surface delay system 90 has only three outgoing detonator cords, 94, 96 and 98.

In operation, an incoming detonator cord 100 is utilized to initiate surface delay system 90, which in turn, initiates each of outgoing detonator cords 94, 96 and 98. Outgoing detonator cord 94 initiates delay primer system 92 which in turn initiates main borehole explosive charge 102. Delay primer system 92 can incorporate a detonator device in accordance with the invention, such as illustrated in FIG. 3. Outgoing detonator cords 96 and 98 may each be utilized as incoming detonator cords for initiation of other surface delay systems similar to surface delay system 90, or to initiate in hole delay primers similar to in hole delay primer 92 or combinations thereof.

Figure 8:
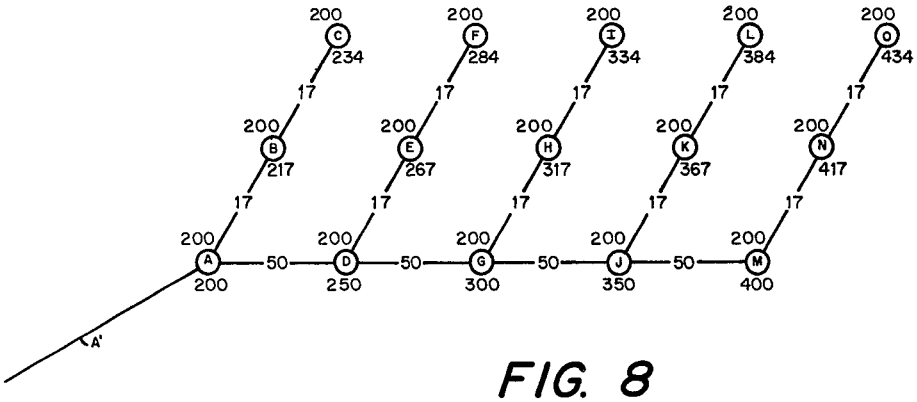
FIG. 8 is a schematic illustration showing use of surface and in-hole delays in a three row blast utilizing the detonator device of the present invention.

In accordance with the present invention, a network of boreholes may be initiated utilizing a plurality of surface delay systems and in-hole delay systems similar to the ones shown in FIG. 7. As illustrated in FIG. 8, each of the reference letters A through P represents a borehole similar to borehole 88 of FIG. 7. A′ refers to the incoming detonator cord that initiates the blast and the lines connecting the boreholes represent detonator cord. The numbers utilized in FIG. 8 refer to the length of the delay, in milliseconds. The numbers along the lines connecting the boreholes, for example, "17," between borehole A and B, represents the time of the surface delay in milliseconds. Such surface delays are achieved utilizing, for example, the device shown in FIG. 6 and shown in FIG. 7 as surface delay system 90. The number above a borehole, for example, above borehole C, "200," represents the time of the in-hole delay in milliseconds. Such in-hole delays can be achieved utilizing, for example, a delay primer system as shown in FIG. 3. The numbers adjacent the bottom of each borehole represent the total delay time at which the borehole detonators, for example, the total delay time of borehole C is 234 milliseconds, of borehole E, 267 milliseconds, etc. Surface and in-hole delay times in FIG. 8 are, of course, only set forth as examples and the use of the invention is not limited to those specific times. Thus, in accordance with the present invention, a large borehole network can be initiated with each borehole being initiated at a different time, utilizing only a small number of different delay time elements (e.g., as in FIG. 8, only three different delay time elements, 17, 50 and 200 milliseconds, were utilized, yet 15 boreholes were initiated at different times).

While the invention has been described with respect to certain preferred embodiments, it will be understood that the invention is not limited to the embodiments disclosed, but is capable of numerous rearrangements, modifications and substitutions without departing from the scope of the invention as set forth in the appended claims.

We claim:

1. A device for securing and aligning a detonator cord and a nonelectric detonator in initiating relationship relative to each other comprising:

(a) a first tube open at both ends and dimensioned for receiving the detonator cord therein; and (b) a second tube open at both ends, the first end of said second tube being joined to the wall of said first tube, and communicating with the interior of said first tube, said second tube dimensioned to allow frictional engagement of the nonelectric delay detonator therein when the nonelectric detonator is adjacent the location where said second tube is joined to said first tube so that the nonelectric detonator can be positioned adjacent the detonator cord to allow initiation of the delay detonator by the detonator cord.

2. The device as recited in claim 1 wherein said first and second tubes are of generally circular cross-section, said first tube having a slot for inserting and locking the detonator cord therein.

3. The device as recited in claim 2 wherein said slot is located at one end of said first tube and has a configuration and is dimensioned for snap-locking the detonator cord for preventing movement of the detonator cord within and longitudinally of said first tube.

4. The device as recited in claim 1 further comprising means for securing said device to the explosive primer charge.

5. The device as recited in claim 4 wherein said means for securing includes a projecting member rigidly secured to said first tube for insertion into a complementary cavity located in the explosive primer charge so that said member is locked in said cavity when inserted therein.

6. The device as recited in claim 1, 2, 3, 4, or 5 wherein the junction of said first tube with said second tube forms an angle of about 90° measured along the longitudinal axes of said first and said second tubes.

7. The device as recited in claim 1 wherein said tubes have a structural rigidity such that said tubes are not ruptured when a detonator cord, contained by said first tube, is initiated.

8. The device as recited in claim 1 wherein the interior of said second tube contains a plurality of circumferential serrations for frictional engagement of the nonelectric detonator.

9. A detonator device for initiating an explosive primer charge, a cartridge type explosive or an outgoing detonator cord from an explosive signal received from a detonator cord, comprising:

(a) a nonelectric delay detonator;

(b) a first tube open at both ends for receiving the detonator cord therein; and (c) a second tube open at both ends, the first end of said second tube being joined to the wall of said first tube and communicating with the interior of said first tube, said second tube dimensioned to allow frictional engagement of said detonator therein when said detonator is positioned adjacent the location of where said second tube is joined to said first tube so that said detonator can be positioned adjacent the detonator cord for initiation of said detonator by the detonator cord.

10. The device as recited in claim 9 wherein an end of said first tube contains therein a slot for inserting and locking the detonator cord.

11. The device as recited in claim 10 wherein said slot has a configuration and is dimensioned for snap-locking the detonator cord therein.

12. The device as recited in claim 9 wherein said device is utilized to initiate a primer charge and includes means for securing said device to an explosive primer charge in initiating relationship.

13. The device as recited in claim 12 wherein said means for securing includes a projecting member rigidly secured to said first hollow member for insertion into a complementary cavity located in the explosive primer charge so that said member is locked in said cavity when inserted therein.

14. The device as recited in claim 9 wherein the junction of said first hollow member with said second hollow member forms an angle of about 90° measured along the longitudinal axes of said first and second hollow members.

15. The device as recited in claim 9 wherein said nonelectric delay detonator comprises a hollow shell closed at one end with the following, contained in sequence in said shell from said closed end:

(a) a base explosive charge;

(b) a primer explosive charge located adjacent and in contact with said base explosive charge;

(c) delay means for initiating said primer explosive;

(d) passive signal carrier means for transmitting an explosive signal for initiating said delay element; and (e) a sensor means for sensing the detonation signal from the detonator cord and for producing a detonation signal for transmission through said passive signal carrier means, said detonation signal having sufficient strength to initiate said delay means.

16. The device as recited in claim 15 wherein said detonator further comprises attenuator means for focusing the detonation signal from said sensor means, said attenuator means being located between said sensor and said delay means.

17. The device as recited in claim 15 wherein the amount of said base explosive charge contained within said detonator shell is equivalent to a number 8 blasting cap.

18. The device as recited in claim 9 further comprising means for retaining at least one outgoing detonator cord adjacent said nonelectric detonator for initiation by said nonelectric detonator.

19. The device as recited in claim 18 wherein said retaining means includes a cap member having a well portion defined therein for securing the bottom end of said nonelectric detonator within said well portion, said cap member further including at least one passageway therein for receiving and retaining said outgoing detonator cord in a position proximate said nonelectric detonator to allow initiation of said outgoing detonator cord by detonation of said nonelectric delay detonator.

20. The device as recited in claim 19 wherein the well of said cap member frictionally engages the bottom portion of said nonelectric detonator.

21. The device as recited in claim 19 wherein said cap member includes a plurality of passageways for receiving and retaining a like number of outgoing detonator cords, each of said outgoing detonator cords retained by said cap in a position proximate said nonelectric detonator to allow initiation of each of said outgoing detonator cords by detonation of said nonelectric detonator.

22. In a detonator device for initiating one or more outgoing detonator cords in response to an explosive signal received from a detonator cord wherein the detonator device includes a nonelectric delay detonator, a first tube open at both ends for receiving the detonator cord therein and a second tube open at both ends, the first end of the second tube being joined to the wall of the first tube and communicating with the interior of the first tube, the second tube dimensioned to allow frictional engagement of the detonator therein when the detonator is positioned adjacent the location of where the second tube is joined to the first tube for positioning the detonator adjacent the detonator cord thereby allowing initiation of the detonator by the detonator cord, the improvement comprising:

a cap member having a well portion defined therein for securing the bottom end of the nonelectric detonator within said well portion, said cap member further including at least one passageway therein for receiving and retaining the outgoing detonator cord in a position proximate the nonelectric detonator for allowing initiation of the outgoing detonator cord by detonation of the nonelectric delay detonator.

23. The cap member as recited in claim 22 wherein said cap member includes a plurality of passageways for receiving and retaining a like number of outgoing detonator cords, each of the outgoing detonator cords retained by said cap member in a position proximate the nonelectric detonator for allowing initiation of each of the outgoing detonator cords by detonation of the nonelectric detonator.

24. The cap member as recited in claim 22 wherein the well of said cap member frictionally engages the bottom portion of said nonelectric detonator.

* * * * *